US007434909B2

(12) United States Patent
Suzuki et al.

(10) Patent No.: US 7,434,909 B2
(45) Date of Patent: Oct. 14, 2008

(54) INK-JET HEAD AND HEAD UNIT

(75) Inventors: Isao Suzuki, Mishima (JP); Yoshiro Eto, Tagata-gun (JP); Masashi Shimosato, Izunokuni (JP); Takahisa Ikeda, Mishima (JP); Megumi Shimizu, Mishima (JP); Minoru Koyata, Mishima (JP); Hideaki Nishida, Izunokuni (JP); Takashi Kukuchi, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/617,040

(22) Filed: Dec. 28, 2006

(65) Prior Publication Data

US 2008/0158295 A1 Jul. 3, 2008

(51) Int. Cl.
*B41J 2/15* (2006.01)

(52) U.S. Cl. ..... 347/40

(58) Field of Classification Search ..... 347/12, 347/40, 43, 42, 49

See application file for complete search history.

(56) References Cited

U.S. PATENT DOCUMENTS

| | | | | |
|---|---|---|---|---|
| 6,065,822 | A * | 5/2000 | Sarraf | 347/15 |
| 6,375,294 | B1 * | 4/2002 | Kneezel | 347/9 |
| 6,779,870 | B2 | 8/2004 | Watanabe et al. | |
| 2005/0122354 | A1 | 6/2005 | Yamane et al. | |
| 2005/0212854 | A1 | 9/2005 | Akahira et al. | |

* cited by examiner

*Primary Examiner*—Lamson D. Nguyen
(74) *Attorney, Agent, or Firm*—Amin, Turocy & Calvin, LLP

(57) ABSTRACT

An ink-jet head includes a nozzle array including plural nozzles. The nozzle array has a first nozzle group arranged in the center thereof and second nozzle groups arranged further on outer sides than the first nozzle group. Inter-nozzle pitches of the second nozzle groups are larger than inter-nozzle pitches of the first nozzle group. A direction in which nozzles of the second nozzle group eject an ink and a direction in which nozzles of the first nozzle group eject the ink are different.

7 Claims, 5 Drawing Sheets

INK-JET HEAD AND HEAD UNIT

BACKGROUND OF THE INVENTION

1. Field of the Invention

The present invention relates to an ink-jet head and a head unit that eject an ink to a recording medium.

2. Description of the Related Art

For example, U.S. 2005/0122354A1 discloses an ink-jet head in which so-called end dot deflection is reduced. This ink-jet head has plural recording element substrates. Recording areas of the recording element substrates are arranged to overlap one another.

When ink droplets are ejected at high recording density, ink droplets ejected from nozzles located at both the ends of an ink-jet head deviate toward the center of the ink-jet head. This phenomenon is referred to as "end dot deflection". In this ink-jet head, correction for adjusting the number of recording elements used for actual ejection is performed according to recording density. A stable image with a fixed quality is obtained according to this correction.

Further, U.S. 2005/0212854A1 discloses an ink-jet head that provides a time difference when ink droplets are landed on a recording medium. In this ink-jet head, plural head chips are arranged in a zigzag shape to function as one long ink-jet head as a whole. In forming dots on the recording medium in this ink-jet head, when dots adjacent to one another have to be formed, the dots are formed with a time difference equal to or longer than time in which an ink is absorbed by the recording medium. This prevents ink droplets from combining on the recording medium to damage a desirable dot shape.

However, in the invention disclosed in U.S. 2005/0122354A1, it is necessary to perform correction for adjusting recording elements actually used for ejection. Thus, it is likely that adjustment of the ink-jet head takes time. Further, since there are nozzles not used for ejection, the nozzles are wasted.

In the invention disclosed in U.S. 2005/0212854A1, there is no indication about end dot deflection. Thus, it is likely that, when end dot deflection occurs, it is impossible to cope with the end dot deflection.

It is an object of the invention to provide an ink-jet head that can cope with "end dot deflection" of an ink with a simple structure.

BRIEF SUMMARY OF THE INVENTION

In order to attain the object, an ink-jet head according to an aspect of the invention includes a nozzle array including plural nozzles. The nozzle array has a first nozzle group arranged in the center thereof and second nozzle groups arranged further on outer sides than the first nozzle group. Inter-nozzle pitches of the second nozzle groups are larger than inter-nozzle pitches of the first nozzle group.

In order to attain the object, an ink-jet head according to another aspect of the invention includes a nozzle array including plural nozzles. The nozzle array has a first nozzle group arranged in the center thereof and second nozzle groups arranged further on outer sides than the first nozzle group. Nozzles of the second nozzle groups eject an ink obliquely in directions of outer sides at both the ends of the nozzle array.

In order to attain the object, a head unit according to still another aspect of the invention includes a first ink-jet head that has a first nozzle array including plural nozzles and a second ink-jet head that has a second nozzle array including plural nozzles. The first nozzle array has a first nozzle group arranged in the center thereof and second nozzle groups arranged further on outer sides than the first nozzle group. Inter-nozzle pitches of the second nozzle groups are larger than inter-nozzle pitches of the first nozzle group. The inter-nozzle pitches of the second nozzle array are uniform.

In order to attain the object, a head unit according to still another aspect of the invention includes a first ink-jet head that has a first nozzle array including plural nozzles and a second ink-jet head that has a second nozzle array including plural nozzles. The first nozzle array has a first nozzle group arranged in the center thereof and second nozzle groups arranged further on outer sides than the first nozzle group. Nozzles of the second nozzle groups eject an ink obliquely in directions of outer sides at both the ends of the first nozzle array. Inter-nozzle pitches of the second nozzle array are uniform.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

A first embodiment of an ink-jet recording apparatus will be hereinafter explained with reference to FIGS. 1 to 3. This ink-jet recording apparatus is mounted on an ink jet-recording apparatus and ejects ink droplets on a recording medium such as a sheet and forms characters, figures, signs, and images thereon.

Figure 1:
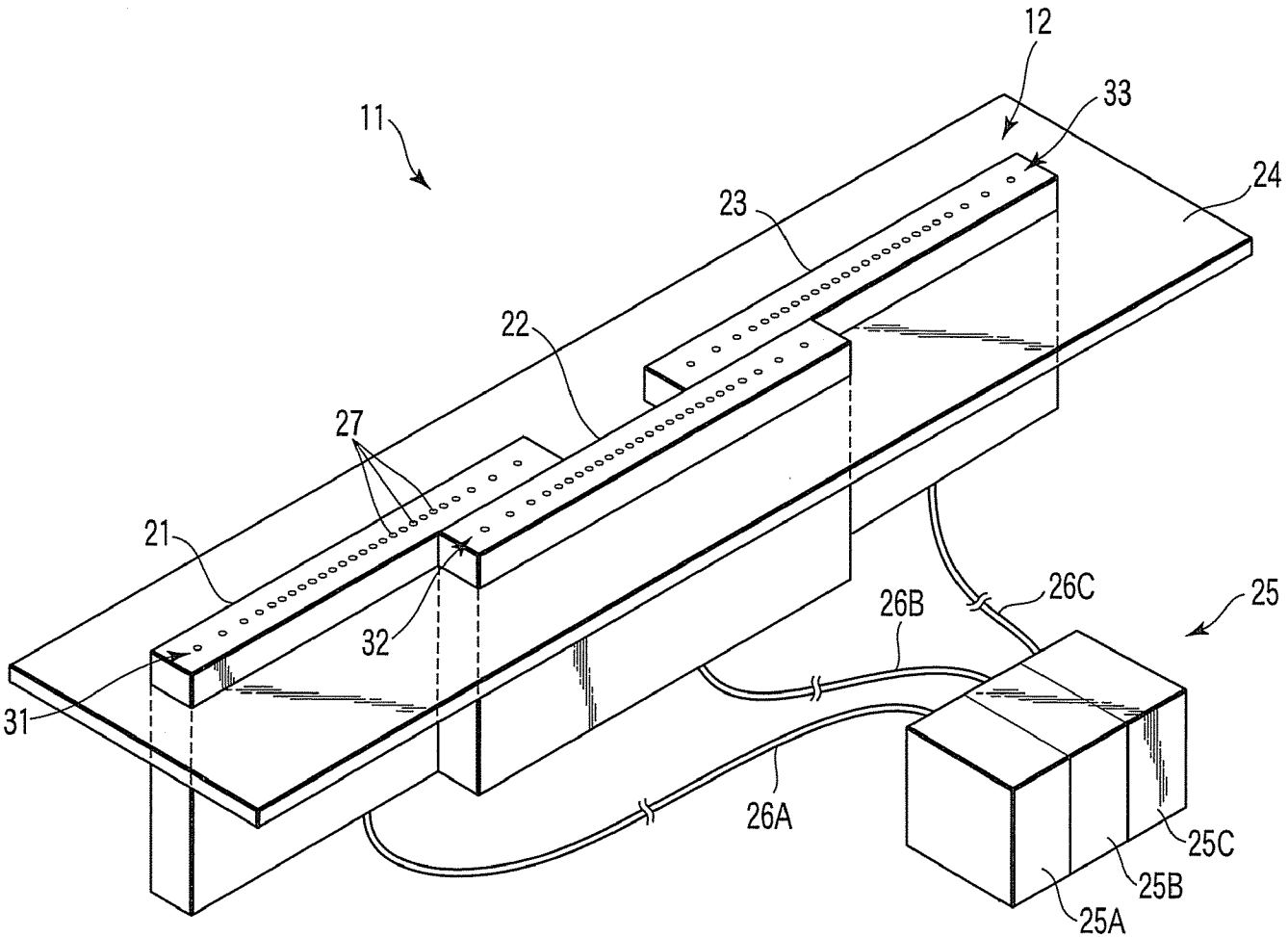
FIG. 1 is a perspective view of an ink-jet recording apparatus according to a first embodiment of the invention.

As shown in FIG. 1, an ink-jet recording apparatus 11 has a head unit 12 and an ink tank 25 that supplies an ink to first to third ink-jet heads 21, 22, and 23 of the head unit 12.

The head unit 12 has the first ink-jet head 21, the second ink-jet head 22, the third ink-jet head 23, and a plate 24 for attaching the first to the third ink-jet heads 21, 22, and 23. The first ink-jet head 21 has a first nozzle array 31. The second ink-jet head 22 has a second nozzle array 32. The third ink-jet head 23 has a third nozzle array 33.

The ink tank 25 has a first tank 25A for supplying the ink to the first ink-jet head 21, a second tank 25B for supplying the ink to the second ink-jet head 22, and a third tank 25C for supplying the ink to the third ink-jet head 23.

The first ink-jet head 21 and the first tank 25A are connected by a first tube 26A. The second ink-jet head 22 and the second tank 25B are connected by a second tube 26B. The third ink-jet head 23 and the third tank 25C are connected by a third tube 26C.

Figure 2:
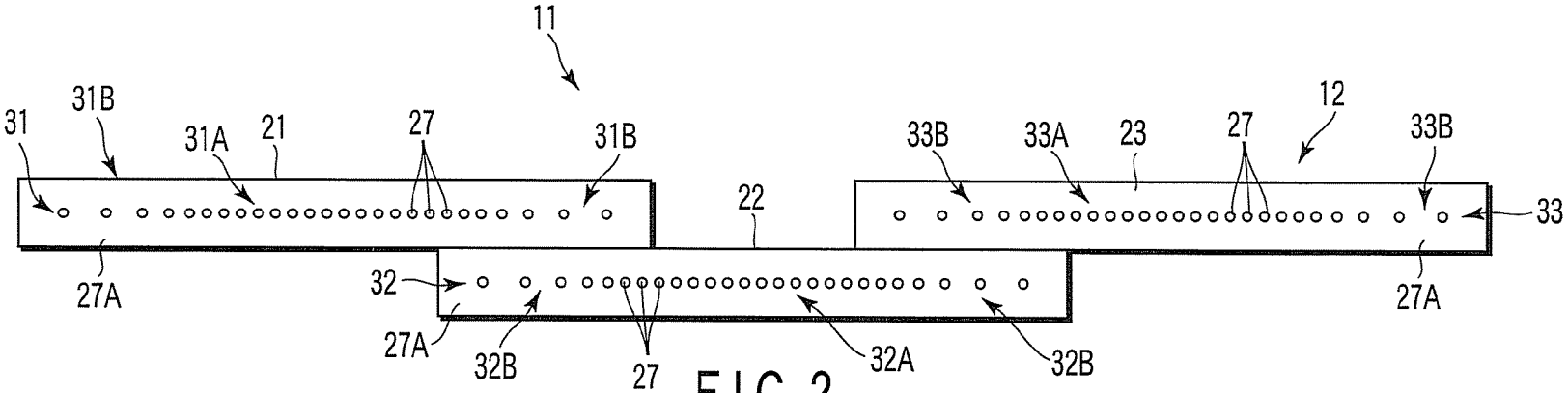
FIG. 2 is a bottom view showing a head unit of the ink-jet recording apparatus shown in FIG. 1.

As shown in FIG. 2, the first ink-jet head 21 and the second ink-jet head 22 of the head unit 12 are arranged in zigzag to partially overlap each other in a direction in which the first and the second nozzle arrays 31 and 32 extend. The second ink-jet head 22 and the third ink-jet head 23 are arranged in zigzag to partially overlap each other in a direction in which the second and the third nozzle arrays 32 and 33 extend. The first to the third ink-jet heads 21, 22, and 23 have the same structure. Therefore, the first ink-jet head 21 will be explained below.

Figure 3:
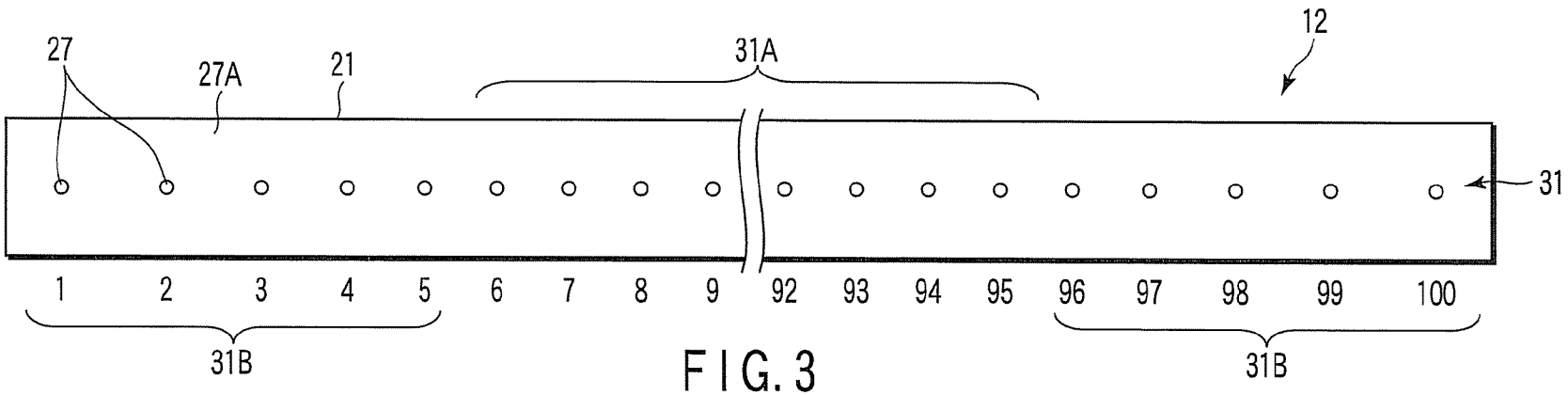
FIG. 3 is a bottom view showing a first ink-jet head of the head unit shown in FIG. 2.

As shown in FIGS. 2 and 3, in the first nozzle array 31, for example, one hundred nozzles 27 in total from #1 to #100 are provided on a nozzle plate 27A. The first nozzle array 31 has a first nozzle group 31A arranged in the center thereof and second nozzle groups 31B arranged further on outer sides than the first nozzle group 31A. The second nozzle groups 31B are provided as a pair on both the outer sides of the first nozzle group 31A.

Inter-nozzle pitches of the first nozzle group 31A refer to distances among the nozzles 27 adjacent to one another. The inter-nozzle pitches of the first nozzle group 31A are uniform and are, for example, 40 μm.

Inter-nozzle pitches of the second nozzle groups 31B are larger than the inter-nozzle pitches of the first nozzle group 31A. In other words, the inter-nozzle pitches of the second nozzle groups 31B are equal to or larger than 40 μm. More specifically, the inter-nozzle pitches of the second nozzle groups 31B increase toward both the ends of the first nozzle array 31.

The second ink-jet head 22 has a first nozzle group 32A and second nozzle groups 32B that are the same as those in the first ink-jet head 21. The third ink-jet head 23 has a first nozzle group 33A and second nozzle groups 33B that are the same as those in the first ink-jet head 21.

Figure 4:
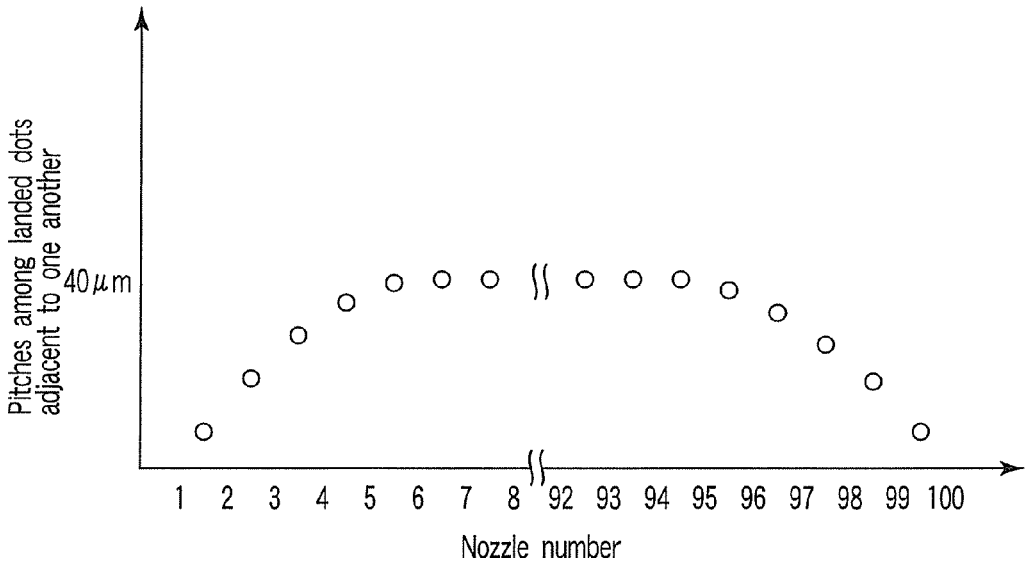
FIG. 4 is a graph showing pitches among ink droplets ejected from an ink-jet head having uniform inter-nozzle pitches.

An example of ejection of ink droplets will be explained with reference to FIG. 4. In the example, ink droplets are ejected on a recording medium, which is assumed to be 2 mm apart from the surface of the nozzle plate 27A, using an ink-jet head that has a nozzle array with uniform inter-nozzle pitches. When ejection of ink droplets is performed at high recording density using nozzles arranged at uniform pitches, a phenomenon called "end dot deflection" is observed at both the ends of the nozzle array. A cause of "end dot deflection" is not clear. As shown in FIG. 4, because of this phenomenon, ink droplets ejected from nozzles at both the ends of the nozzle array land on a recording medium deviating to the center of the ink-jet head. Therefore, pitches among dots adjacent to one another landed on the recording medium decrease toward both the ends of the nozzle array. It is confirmed that numerical values of the pitches fluctuate according to a clearance of recording media.

Figure 5:
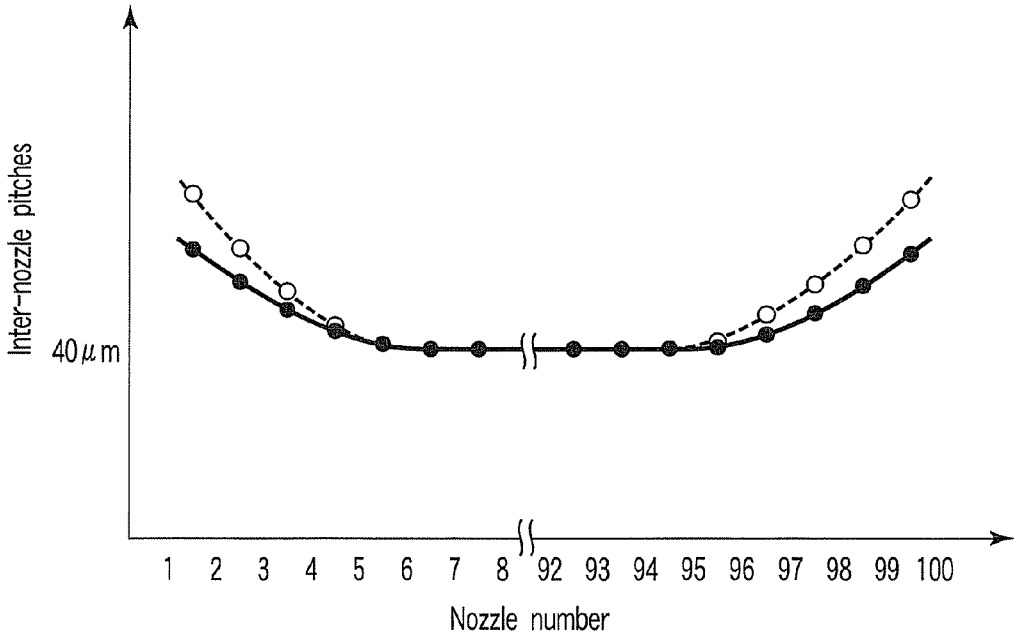
FIG. 5 is a graph showing inter-nozzle pitches of the first ink-jet head shown in FIG. 3.

In FIG. 5, arrangements of the nozzles 27 of the first to the third ink-jet heads 21, 22, and 23 according to this embodiment are indicated by a solid line and dots. Values obtained by adding the inter-nozzle pitches 40 μm of the first nozzle group 31A and a distance of movement of ink droplets by "end dot deflection" are indicated by a broken line and circles. The inventor has found that, when the inter-nozzle pitches of the second nozzle groups 31B are set to numerical values indicated by the broken line and the circles, end dot deflection does not occur depending on conditions. Therefore, in this embodiment, the inter-nozzle pitches of the second nozzle groups 31B are set to a value smaller than the numerical values indicated by the broken line. This value is found experimentally and set as appropriate according to distances between the first to the third ink-jet heads 21, 22, and 23 and a recording medium.

Print processing using the ink-jet recording apparatus 11 according to this embodiment will be explained. The ink-jet recording apparatus 11 applies printing to a recording medium at high recording density and applies, for example, coating processing to the entire surface of the recording medium.

The first to the third ink-jet heads 21, 22, and 23 of the head unit 12 apply print processing to the recording medium at high recording density using all the nozzles 27. In applying the print processing, the first to the third tanks 25A, 25B, and 25C supply an ink to the first to the third ink-jet heads 21, 22, and 23.

Ink droplets ejected from the nozzles 27 included in the first nozzle group 31A are linearly ejected on the recording medium. Ink droplets ejected from the nozzles 27 included in the second nozzle groups 31B gather in the center of the first ink-jet head 21 because of "end dot deflection". However, in this embodiment, the inter-nozzle pitches of the second nozzle groups 31B increase toward both the ends of the first nozzle array 31. Thus, the ink droplets land on correct positions on the recording medium. This makes pitches among the ink droplets landed on the recording medium uniform.

The first embodiment of the ink-jet recording apparatus is described above. According to the first embodiment, the inter-nozzle pitches of the second nozzle groups 31B are larger than the inter-nozzle pitches of the first nozzle group 31A. According to this constitution, since the inter-nozzle pitches of the second nozzle groups 31B are larger than normal inter-nozzle pitches, it is possible to mitigate the phenomenon of "end dot deflection".

In this case, the inter-nozzle pitches of the second nozzle groups 31B increase toward both the ends of the first nozzle array 31. According to FIG. 4, ink droplets ejected from the nozzles 27 located at both the ends of the first nozzle array 31 move by a great degree because of the "end dot deflection" phenomenon. However, ink droplets ejected from the nozzles 27 close to both the ends of the first nozzle array 31 move in a very small distance because of the "end dot deflection" phenomenon. According to this constitution, it is possible to arrange the nozzles 27 by shifting positions thereof from one another in association with the "end dot deflection" phenomenon in which an amount of movement of ink droplets increases toward both the ends of the first nozzle array 31. This makes it possible to mitigate the "end dot deflection" phenomenon and land ink droplets in proper positions on recording media that are conveyed while keeping a clearance decided in advance.

In this case, the inter-nozzle pitches of the first nozzle group 31A are uniform. According to this constitution, the inter-nozzle pitches of the second nozzle groups 31B are smaller than a value obtained by adding the inter-nozzle pitches of the first nozzle group 31A in the center of the first nozzle array 31, in which the "end dot deflection" phenomenon is not observed, and the distance of the movement of the ink droplets due to end dot deflection. Usually, the "end dot deflection" phenomenon is observed when printing is performed at high recording density. When recording density falls, "end dot deflection" less easily occurs. Therefore, when the inter-nozzle pitches of the second nozzle groups 31B are simply set to the value obtained by adding the inter-nozzle pitches of the first nozzle group 31A and the distance of the movement of the ink droplets due to end dot deflection, "end dot deflection" does not occur in the second nozzle groups 31B in which the inter-nozzle pitches are set large. As a result, the ink lands on the recording medium while keeping the large pitches. In this embodiment, since the inter-nozzle pitches of the second nozzle groups 31B are set smaller than the value, it is possible to prevent the situation in which "end dot deflection" does not occur in the ink ejected from the second nozzle groups 31B and pitches among ink droplets landed on the recording medium become inappropriate.

Figure 6:
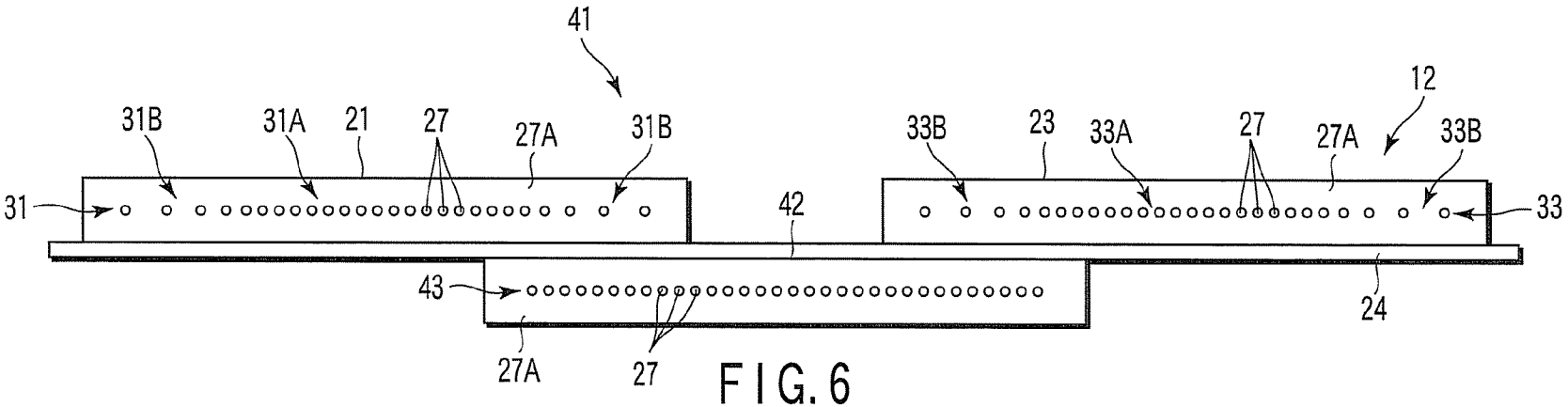
FIG. 6 is a bottom view showing a head unit of an ink-jet recording apparatus according to a second embodiment of the invention.

A second embodiment of an ink-jet recording apparatus 41 will be explained with reference to FIG. 6. The ink-jet recording apparatus 41 according to the second embodiment is different from the ink-jet recording apparatus 11 according to the first embodiment in a structure of a second ink-jet head 42. However, the other components are the same as those in the first embodiment. Thus, the difference is mainly explained. The same components are denoted by the same reference numerals and signs and explanations of the components are omitted.

The ink-jet recording apparatus 41 has the head unit 12 and the ink tank 25 that supplies an ink to first to third ink-jet heads 21, 42, and 23 of the head unit 12.

The head unit 12 has the first ink-jet head 21, the second ink-jet head 42, the third ink-jet head 23, and the plate 24 for attaching the first to the third ink-jet heads 23.

The second ink-jet head 42 includes a second nozzle array 43. The second nozzle array 43 includes the plural nozzles 27. In the second nozzle array 43, for example, one hundred nozzles 27 in total from #1 to #100 are provided on the nozzle plate 27A. Inter-nozzle pitches of the second nozzle array 43 are uniform and are, for example, 40 μm. The nozzles 27 of the second nozzle array 43 are opened in a direction orthogonal to a recording medium. In other words, the nozzles 27 of the second nozzle array 43 are opened in the vertical direction.

The first ink-jet head 21 includes the first nozzle array 31. The first nozzle array 31 has, for example, one hundred nozzles 27 in total from #1 to #100. The first nozzle array 31 has the first nozzle group 31A arranged in the center thereof and the second nozzle groups 31B arranged further on outer sides than the first nozzle group 31A. The second nozzle groups 31B are provided as a pair on both the outer sides of the first nozzle group 31A.

Inter-nozzle pitches of the first nozzle group 31A refer to distances among the nozzles 27 adjacent to one another. The inter-nozzle pitches of the first nozzle group 31A are uniform and are, for example, 40 μm.

Inter-nozzle pitches of the second nozzle groups 31B are larger than the inter-nozzle pitches of the first nozzle group 31A. The inter-nozzle pitches of the second nozzle groups 31B increase toward both the ends of the first nozzle array 31. The inter-nozzle pitches of the second nozzle group 31B are smaller than a value obtained by adding the inter-nozzle pitches of the first nozzle group 31A and a distance of movement of ink droplets due to end dot deflection.

Print processing using the ink-jet recording apparatus 41 according to the second embodiment will be explained. In this embodiment, an ink-jet head used for printing is switched according to recording density of the printing.

When printing is applied to the recording medium at high recording density, for example, using the nozzles 27 equal to or more than 50% of all the nozzles, the "end dot deflection" phenomenon occurs. Therefore, for the printing at high recording density, the first ink-jet head 21 and the third ink-jet head 23, which cope with "end dot deflection", are used. Consequently, ink droplets land in desirable positions on the recording medium.

On the other hand, when printing is applied to the recording medium at low recording density, for example, using the nozzles 27 equal to or less than 50% of all the nozzles, the "end dot deflection" phenomenon is hardly observed. Therefore, for the printing at low recording density, the second ink-jet head 42 having the normal inter-nozzle pitches is used. Consequently, ink droplets land in desirable positions on the recording medium.

The second embodiment of the ink-jet recording apparatus is described above. According to the second embodiment, the head unit 12 has the first and the third ink-jet heads 21 and 23, which cope with the "end dot deflection" phenomenon, and the second ink-jet head 42 having the normal inter-nozzle pitches. Therefore, it is possible to switch an ink-jet head used for printing according to recording density of the printing. Consequently, when printing is performed at high recording density and when printing is performed at low recording density, it is possible to appropriately correct landing positions of ink droplets and improve a printing quality.

A third embodiment of an ink-jet recording apparatus will be explained with reference to FIGS. 7, 8, and 9. An ink-jet recording apparatus 51 according to the third embodiment is different from the ink-jet recording apparatus 41 according to the second embodiment in structures of a first ink-jet head 52 and a third ink-jet head 53. However, the other components are the same as those in the second embodiment. Thus, the difference is mainly explained. The same components are denoted by the same reference numerals and signs and explanations of the components are omitted.

The ink-jet recording apparatus 51 has the head unit 12 and the ink tank 25 that supplies an ink to respective ink-jet heads of the head unit 12.

The head unit 12 has a first ink-jet head 52, the second ink-jet head 42, a third ink-jet head 53, and the plate 24 for attaching the first to the third ink-jet heads 52, 42, and 53.

The second ink-jet head 42 includes the second nozzle array 43. The second nozzle array 43 includes the plural nozzles 27. Inter-nozzle pitches of the second nozzle array 43 are formed uniform. The nozzles 27 of the second nozzle array 43 are opened in a direction orthogonal to a recording medium 55 shown in FIG. 9. In other words, the nozzles 27 of the second nozzle array 43 are opened in a direction orthogonal to the surface of a nozzle plate 27A shown in FIG. 8.

Since the first ink-jet head 52 and the third ink-jet head 53 have the same structure, the first ink-jet head 52 will be explained.

Figure 7:
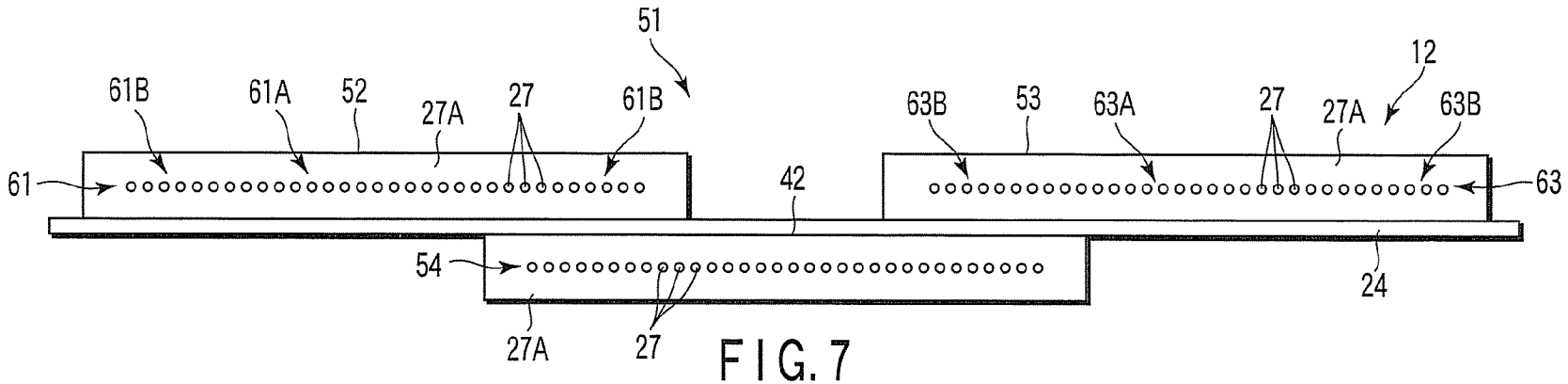
FIG. 7 is a bottom view showing a head unit of an ink-jet recording apparatus according to a third embodiment of the invention.

The first ink-jet head 52 shown in FIG. 7 has a first nozzle array 61. The first nozzle array 61 includes the plural nozzles 27. The first nozzle array 61 has a first nozzle group 61A arranged in the center thereof and second nozzle groups 61B arranged further on the outer sides than the first nozzle group 61A. In the first nozzle array 61, for example, one hundred nozzles 27 in total from #1 to #100 are provided on the nozzle plate 27A. Inter-nozzle pitches of the first nozzle array 61 are uniform.

The first nozzle array 61 has the first nozzle group 61A arranged in the center thereof and the second nozzle groups 61B arranged further on the outer sides than the first nozzle group 61A. The second nozzle groups 61B are provided as a pair on the outer sides of the first nozzle group 61A.

Figure 8:
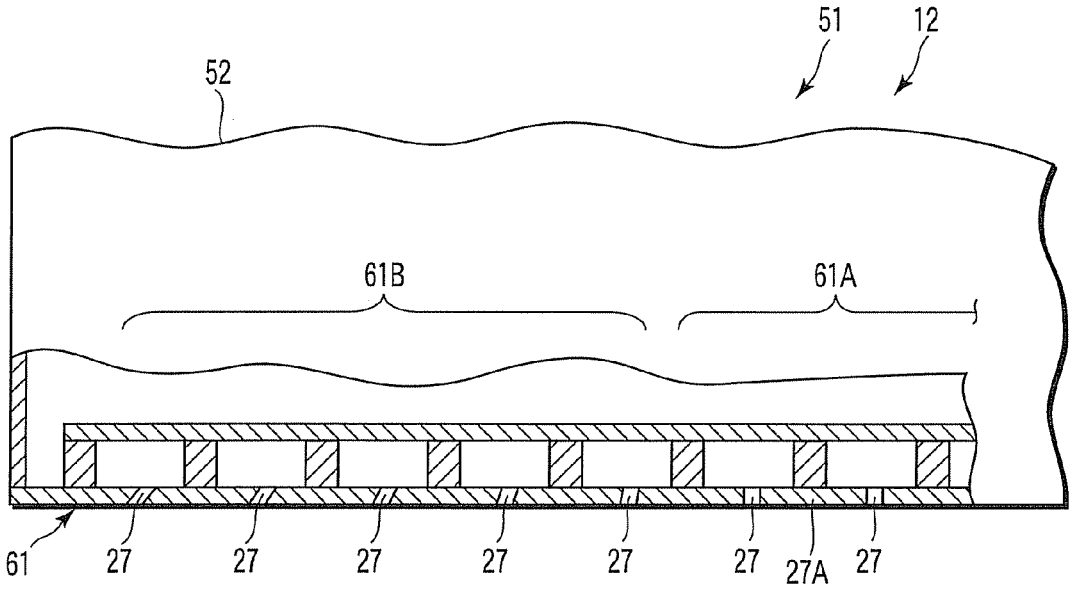
FIG. 8 is a sectional view showing a first ink-jet head of the head unit shown in FIG. 7.
Figure 9:
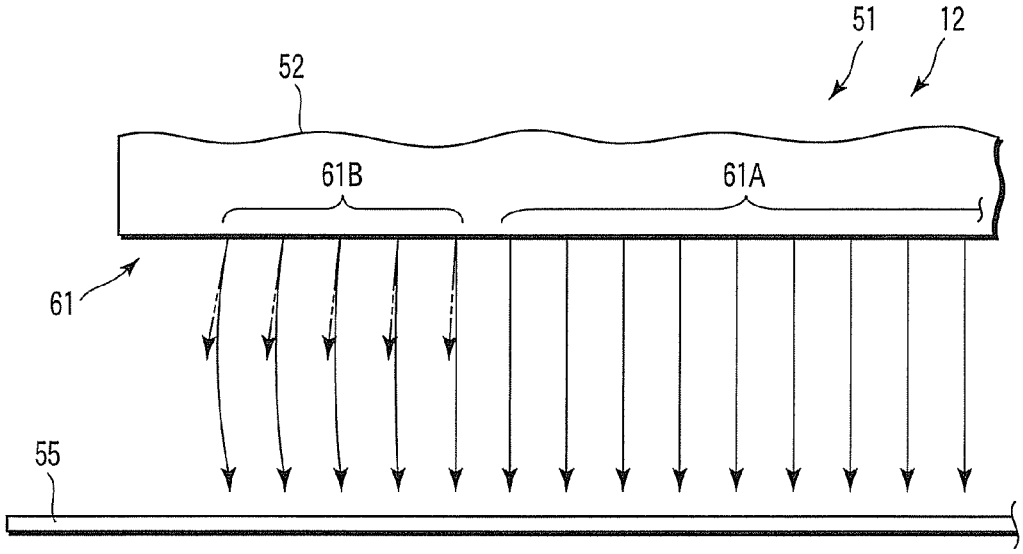
FIG. 9 is a front view showing ejection of ink droplets performed by using the first ink-jet head shown in FIG. 8.

As shown in FIG. 8, the nozzles 27 of the first nozzle group 61A are opened in a direction orthogonal to the recording medium 55 shown in FIG. 9, i.e., the vertical direction. The nozzles 27 of the second nozzle group 61B are opened obliquely to the direction in which the nozzles 27 of the first nozzle group 61A are opened. In other words, the nozzles 27 of the second nozzle group 61B incline obliquely in directions of both the ends of the first nozzle array 61. An angle of inclination of the nozzles 27 increases toward both the ends of the first nozzle array 61. Therefore, an angle formed by the direction in which the nozzles 27 of the second nozzle groups 61B are opened and the direction in which the nozzles 27 of the first nozzle group 61A are opened increases toward both the ends of the first nozzle array 61.

The third ink-jet head 53 has a third nozzle array 63 having the same structure as the first ink-jet head 52. In other words, the third nozzle array 63 has a first nozzle group 63A and second nozzle groups 63B.

Print processing using the ink-jet recording apparatus 51 according to the third embodiment will be explained. In this embodiment, an ink-jet head used for printing is switched according to recording density of the printing.

When printing is applied to the recording medium 55 at high recording density, for example, using the nozzles 27 equal to or more than 50% of all the nozzles, the "end dot deflection" phenomenon occurs. Therefore, for the printing at high recording density, the first ink-jet head 52 and the third ink-jet head 53, which cope with "end dot deflection", are used. FIG. 9 shows the neighborhood of one end of the first nozzle array 61 of the first ink-jet head 52. As shown in FIG. 9, ink droplets ejected from the end of the first nozzle array 61 are ejected obliquely to the recording medium 55. However, the ink droplets land closer to the center of the first ink-jet head 52 because of the "end dot deflection" phenomenon. Consequently, ink droplets land in correct positions on the recording medium 55.

On the other hand, when printing is applied to the recording medium 55 at low recording density, for example, using the nozzles 27 equal to or less than 50% of all the nozzles, the "end dot deflection" phenomenon is hardly observed. Therefore, for the printing at low recording density, the second ink-jet head 22 having the normal inter-nozzle pitches is used. Consequently, ink droplets land in correct positions on the recording medium 55.

The third embodiment of the ink-jet recording apparatus is described above. According to the second embodiment, the head unit 12 has the first and the third ink-jet heads 52 and 53, which cope with the "end dot deflection" phenomenon, and the second ink-jet head 42 having the normal inter-nozzle pitches. Therefore, it is possible to switch an ink-jet head used for printing according to recording density of the printing. Consequently, when printing is performed at high recording density and when printing is performed at low recording density, it is possible to correct landing positions of ink droplets and improve a printing quality. A correlation of the "end dot deflection" phenomenon for each recording density is calculated, a correction value is stored, and an ink-jet head used for printing is switched according to the recording density.

In the first and the third ink-jet heads 52 and 53, the nozzles 27 of the second nozzle groups 61B and 63B are opened obliquely in the directions of both the ends of the first nozzle array 61. According to this constitution, it is possible to mitigate the "end dot deflection" phenomenon without using the method of changing the inter-nozzle pitches of the second nozzle groups 61B and 63B.

An angle formed by the direction in which the nozzles 27 of the second nozzle groups 61B are opened and the direction in which the nozzles 27 of the first nozzle group 61A are opened increases toward both the ends of the first nozzle array 61. According to this constitution, it is possible to incline an ejecting direction of the ink in association with the "end dot deflection" phenomenon in which an amount of movement of ink droplets increases toward both the ends of the first nozzle array 61. This makes it possible to mitigate the "end dot deflection" phenomenon and land ink droplets in proper positions on recording media 55.

Besides, it is possible to modify and carry out the ink-jet recording apparatuses 11, 41, and 51 in various ways without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. An ink-jet head comprising a nozzle array including plural nozzles, wherein the nozzle array includes:

a first nozzle group arranged in a center thereof; and second nozzle groups arranged further on outer sides than the first nozzle group, and inter-nozzle pitches of the second nozzle groups are larger than inter-nozzle pitches of the first nozzle group, the inter-nozzle pitches of the second nozzle group increases toward both ends of the nozzle array, the inter-nozzle pitches of the second nozzle group are smaller than a value obtained by adding the inter-nozzle pitches of the first nozzle group and a distance of movement of ink droplets due to end dot deflection.

2. An ink-jet head according to claim 1, wherein the inter-nozzle pitches of the first nozzle group are uniform.

3. An ink-jet recording apparatus comprising:

a plurality of ink-jet heads; and an ink tank to supply ink to the plurality of ink-jet heads, the ink-jet heads comprising a nozzle array including plural nozzles, wherein the nozzle array includes:

a first nozzle group arranged in a center thereof; and second nozzle groups arranged further on outer sides than the first nozzle group, and inter-nozzle pitches of the second nozzle groups are larger than the inter-nozzle pitches of the first nozzle group, the inter-nozzle pitches of the second nozzle groups increases toward both ends of the nozzle array, the inter-nozzle pitches of the second nozzle groups are smaller than a value obtained by adding the inter-nozzle pitches of the first nozzle group and a distance of movement of ink droplets due to end dot deflection.

4. An ink-jet recording apparatus according to claim 3, wherein the ink-jet heads are arranged to partially overlap each other in a direction in which the nozzle array extends.

5. An ink-jet recording apparatus according to claim 3, wherein the inter-nozzle pitches of the first nozzle group are uniform.

6. A liquid ejecting head comprising a nozzle array including plural nozzles wherein the nozzle array includes:

a first nozzle group arranged in a center thereof; and second nozzle groups arranged further on outer-sides than the first nozzle group, and inter-nozzle pitches of the second nozzle groups are larger than inter-nozzle pitches of the first nozzle group, the inter-nozzle pitches of the second nozzle groups increases toward both ends of the nozzle array, the inter-nozzle pitches of the second nozzle groups are smaller than a value obtained by adding the inter-nozzle pitches of the first nozzle group and a distance of movement of ink droplets due to end dot deflection.

7. A liquid ejecting head according to claim 6, wherein the inter-nozzle pitches of the first nozzle group are uniform.

* * * * *

UNITED STATES PATENT AND TRADEMARK OFFICE

CERTIFICATE OF CORRECTION

PATENT NO. : 7,434,909 B2
APPLICATION NO. : 11/617040
DATED : October 14, 2008
INVENTOR(S) : Isao Suzuki et al.

It is certified that error appears in the above-identified patent and that said Letters Patent is hereby corrected as shown below:

On the Title Page Item (75)
8th inventor's name is misspelled on the Letters Patent: published as "Takashi Kukuchi;" correct spelling is "Takashi Kikuchi."

Signed and Sealed this

Twenty-sixth Day of May, 2009

JOHN DOLL
*Acting Director of the United States Patent and Trademark Office*